US007472873B1

(12) United States Patent
Long

(10) Patent No.: US 7,472,873 B1
(45) Date of Patent: Jan. 6, 2009

(54) UNSUPPORTED SPAN AND METHOD OF USE

(76) Inventor: Noah D. Long, 2313 Joe Brown Hwy. S., Chadbourn, NC (US) 28431

( * ) Notice: Subject to any disclaimer, the term of this patent is extended or adjusted under 35 U.S.C. 154(b) by 0 days.

(21) Appl. No.: 11/820,557

(22) Filed: Jun. 20, 2007

(51) Int. Cl.
*A45D 19/04* (2006.01)

(52) U.S. Cl. ..... 248/127; 248/146; 248/156

(58) Field of Classification Search ..... 40/603; 248/127, 146, 370, 158, 160, 149, 156; 256/37, 256/45
See application file for complete search history.

(56) References Cited

U.S. PATENT DOCUMENTS

| | | | | |
|---|---|---|---|---|
| 2,653,688 | A * | 9/1953 | Gordon | 52/156 |
| D254,809 | S | 4/1980 | Celestian | |
| 4,724,882 | A | 2/1988 | Wang | |
| 4,913,428 | A | 4/1990 | Nauman | |
| 5,078,365 | A * | 1/1992 | Fultz | 256/1 |
| 5,407,178 | A * | 4/1995 | Long | 256/45 |
| 5,490,532 | A | 2/1996 | Mallookis et al. | |
| 5,553,648 | A * | 9/1996 | Goharjou | 160/135 |
| 6,012,505 | A | 1/2000 | Wurz et al. | |
| 6,691,723 | B2 | 2/2004 | Godbersen | |
| 7,266,918 | B2 * | 9/2007 | Huenefeld | 40/611.12 |
| 2006/0060749 | A1 * | 3/2006 | Dahlstrom | 248/545 |
| 2006/0278772 | A1 * | 12/2006 | Walker | 248/156 |

* cited by examiner

*Primary Examiner*—Ramon O Ramirez
(74) *Attorney, Agent, or Firm*—T.L. Garrett, PLC; Tanya L. Garrett

(57) ABSTRACT

An unsupported span device for portable structures and portable signage is provided comprising a plurality of vertical members that provide vertical load-bearing capability to the unsupported span; a plurality of horizontal members for providing a bearing surface for a load applied to the unsupported span; means for fixing the location of the plurality of horizontal members with respect to the plurality of vertical members; a tensioning member for inducing tension between the plurality of vertical members; means for fixing the location of the tensioning member with respect to plurality of vertical members; a plurality of tethers for laterally stabilizing the unsupported span; and a plurality of anchors for providing fixed points of attachment for the plurality of tethers. A method of forming an unsupported span is also provided.

18 Claims, 5 Drawing Sheets

UNSUPPORTED SPAN AND METHOD OF USE

CROSS-REFERENCE TO RELATED APPLICATION

This application claims benefit of and priority to co-pending related Utility patent application Ser. No. 11/820,555 filed Jun. 20, 2007, entitled "PORTABLE SHELTER WITH UNSUPPORTED SPAN AND METHOD OF FORMING", the disclosure of which is incorporated herein by reference in its entirety.

FIELD OF THE INVENTION

The present invention generally relates to unsupported spans for use in the fields of portable structures and portable signage.

BACKGROUND

The use of devices and methods relating to unsupported spans and portable structures are disclosed in U.S. Pat. No. 5,490,532 issued in the name of Mallookis et al., U.S. Pat. No. 6,691,723 B2 issued in the name of Godbersen, U.S. Pat. No. 4,724,882 issued in the name of Wang, U.S. Pat. No. 6,012,505 issued in the name of Wurz et al., U.S. Pat. No. 4,913,428 issued in the name of Nauman, and U.S. Des. Pat. No. 254,809 issued in the name of Celestian.

While existing devices suit their intended purpose, the need remains for a device that provides a structure that is formed from materials that are commonly available, and that does not require any specialized tools to assemble and place.

The present invention advantageously provides an unsupported span that horizontally spans considerable distances without requiring vertical supports at points throughout the span. Additionally, the present invention provides a high degree of rigidity, due to the tensioning of the structural members forming the unsupported span. Additionally, the present invention does not require any complicated means of adjustment, hinges, bolts, or pins. Elimination of these features in the present invention provides substantial cost savings, and provides a structure that may be easily assembled by a wide variety of users.

SUMMARY

An unsupported span device for portable structures and portable signage is provided comprising a plurality of vertical members that provide vertical load-bearing capability to the unsupported span; a plurality of horizontal members for providing a bearing surface for a load applied to the unsupported span; means for fixing the location of the plurality of horizontal members with respect to the plurality of vertical members; a tensioning member for inducing tension between the plurality of vertical members; means for fixing the location of the tensioning member with respect to plurality of vertical members; a plurality of tethers for laterally stabilizing the unsupported span; and a plurality of anchors for providing fixed points of attachment for the plurality of tethers. A method of forming an unsupported span is also provided

BRIEF DESCRIPTION OF THE DRAWINGS

These and other objects, features and advantages of the present invention will become apparent from the following detailed description and the appended drawings in which.

DETAILED DESCRIPTION OF THE INVENTION

Figure 1:
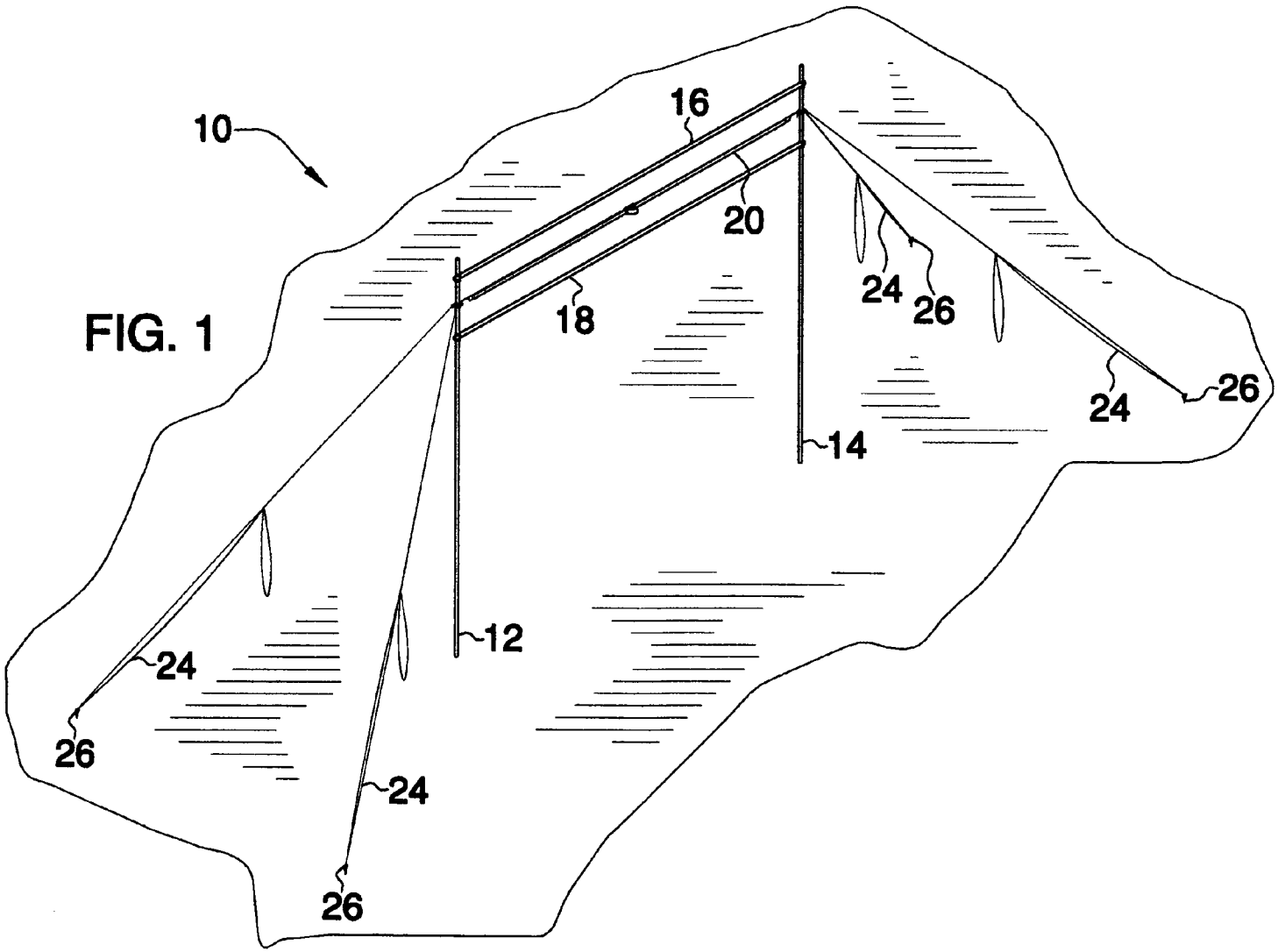
FIG. 1 illustrates a perspective view of an unsupported span in accordance with one embodiment of the invention.

An unsupported span 10 is provided including a first vertical member 12 and a second vertical member 14; an upper horizontal member 16; a lower horizontal member 18; a means for fixing the location of the upper and lower horizontal members with respect to the vertical members 12, 14; a tensioning member 20; a means for fixing the location of the tensioning member with respect to the vertical members 12, 14; a plurality of tethers 24; and a plurality of anchors 26.

As used herein, a vertical member is defined as a member that is vertically oriented member when positioned perpendicularly with respect to the surface upon which the vertical member is placed.

As used herein, a horizontal member is defined as a member that is horizontally oriented when positioned horizontally with respect to the surface upon which the horizontal member is placed.

Figure 2:
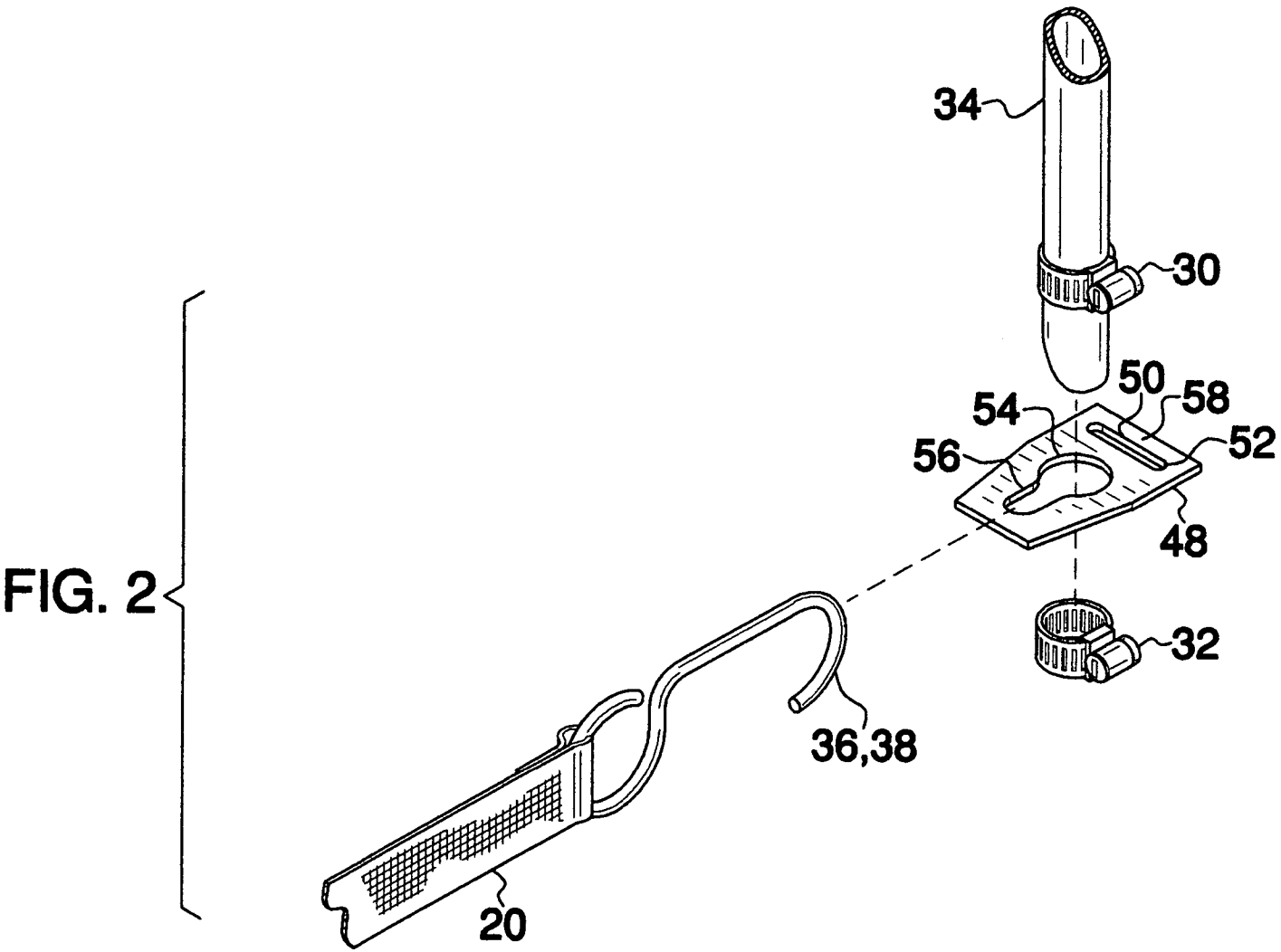
FIG. 2 illustrates an exploded view of the intersection of a vertical member and a horizontal member of an unsupported span in accordance an embodiment of the invention.
Figure 3:
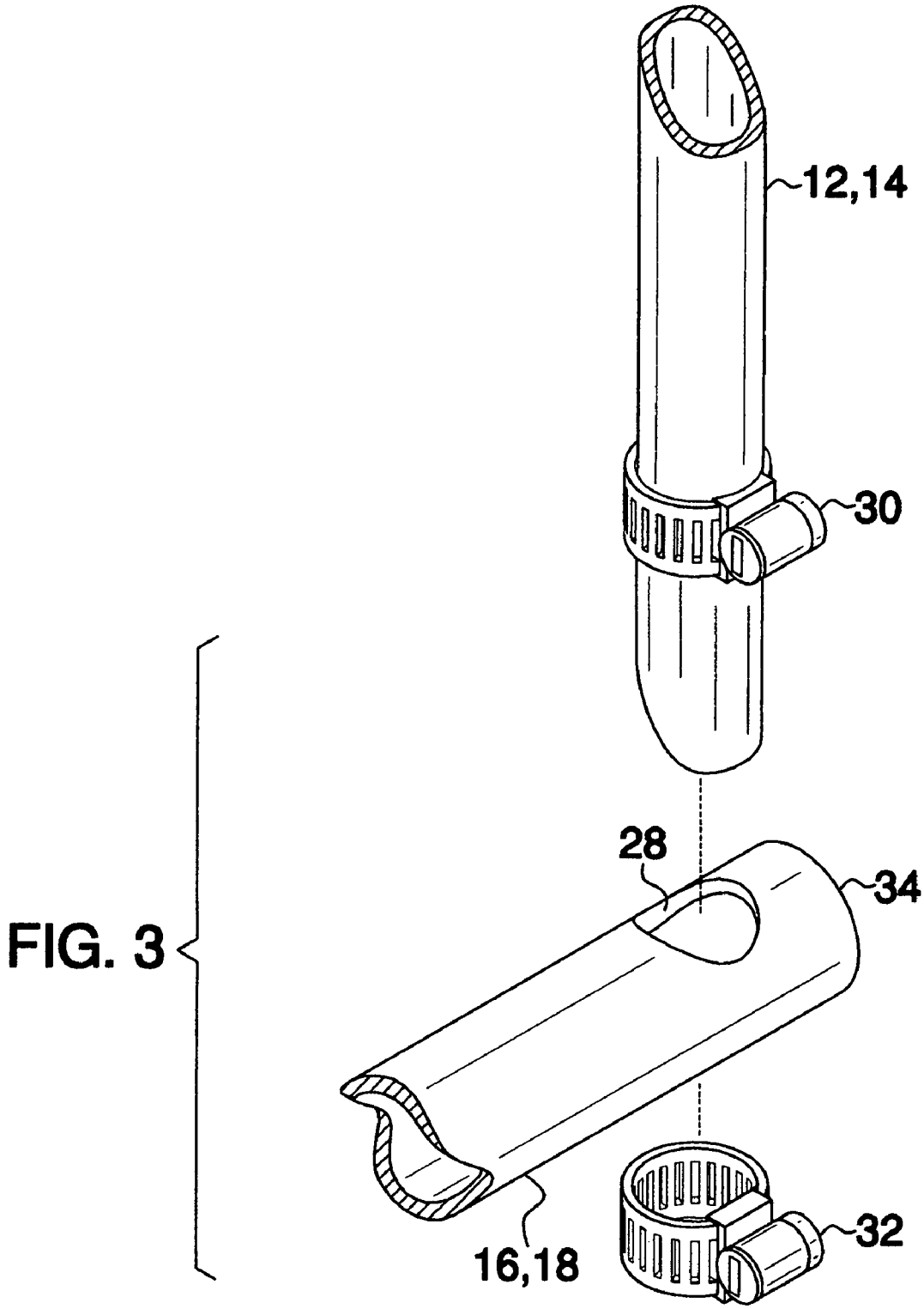
FIG. 3 illustrates an exploded detail view of an unsupported span in accordance with one embodiment of the invention.
Figure 4:
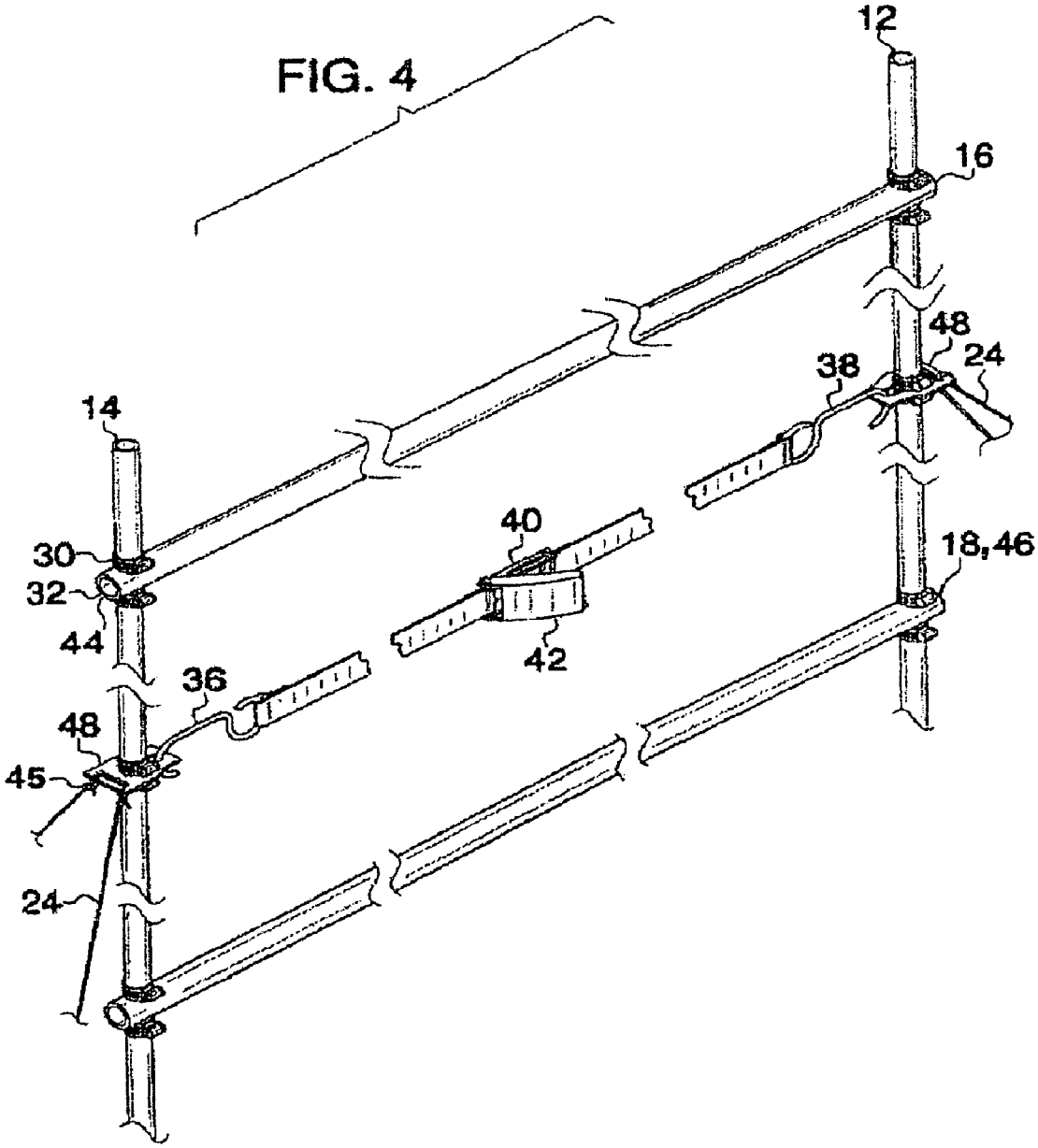
FIG. 4 illustrates a detailed view of an unsupported span in accordance with an embodiment of the invention.

In an embodiment of the invention, the first and second vertical members 12, 14 may have a tubular form, wherein the tubular form may have a geometric cross-section defined by a wall of the tubular forms, as illustrated in FIGS. 2,3. The shape of the geometric cross section may include, but is not limited to: round, obround, rectangular, square, and polygonal.

Each tubular member that forms each of the first and second vertical members 12, 14 is of sufficient strength to allow each respective vertical member to be driven into the ground, either by a user or a machine adapted to perform that operation. Additionally, the first and second vertical members 12, 14 are of sufficient strength so as to support a wide range of loads that may be placed thereupon without bending, buckling, collapsing, or otherwise failing.

The upper and lower horizontal members 16, 18 have a tubular form, wherein the tubular form may have a geometric cross-section, defined by the walls of the tubular forms, as illustrated in FIG. 3. The form of the geometric cross section may include, but is not limited to: round, obround, rectangular, square, and polygonal.

Each of the respective upper and lower horizontal members 16, 18 include an opening defining a hole 28 passing transversely therethrough at a respective first and second end 44, 46 of each respective upper and lower horizontal member 16, 18, as illustrated in FIG. 3. Each respective opening and hole 28 is located such that it passes through each respective upper and lower horizontal member 16, 18 along the centerline of the geometric cross-sectional profile of each respective upper and lower horizontal member 16, 18, and is perpendicular to the longitudinal centerline of each respective upper and lower horizontal member 16, 18. Each of the respective holes 28 is of sufficient size so as to allow passage of one of the first and second vertical members 12, 14 therethrough.

The tubular members forming the vertical members 12, 14 and horizontal members 16, 18 may be formed by methods including, but not limited to: extrusion, pultrusion, and roll forming.

In another embodiment of the invention, it is contemplated that each respective vertical member 12, 14 or horizontal member 16, 18 may be formed of a solid material having a geometric profile substantially similar to that previously described herein in reference to the tubular embodiment of the vertical members 12, 14 and horizontal members 16, 18.

In an embodiment of the invention, the means of fixing the location of each of the respective horizontal members 16, 18 with respect to the vertical members 12, 14 comprises a set of clamps that includes an upper clamp 30 and a lower clamp 32 for each end of each respective horizontal member 16, 18, whereby each unsupported span 10 includes four sets of clamps for fixing the positions of the horizontal members 16, 18. Each of the respective clamps 30, 32 is adapted to be removably mounted around a vertical member 12, 14 using a compressive force applied by the clamps 30, 32 when manipulated by a user. The compressive force is distributed to the outer periphery 34 of each of the respective vertical members 12, 14 to which each respective clamp 30,32 is affixed, thereby fixing the location of each respective clamp 30, 32 when the compressive force is applied.

In an embodiment of the invention, each of the respective upper and lower clamps 30, 32 are formed such that each clamp 30, 32 has a sufficient size such that the larger size of the clamps 30, 32 in relation to the hole 28 passing through each respective horizontal member 16, 18 operates to prevent each respective horizontal member 16, 18 from achieving vertical displacement with respect to each respective vertical member 12, 14 once the upper clamps and lower clamps 32 have been affixed to each respective vertical member 12, 14 in a position that abuts each respective horizontal member 16, 18.

The tensioning member 20 is a flexible member having a first end including an associated first attachment 36; a second end including an associated second attachment 38; a length L; and a tensioning assembly 40 that may be manipulated by a user to induce stress in the tension member 20. It is contemplated that the tension member 20 may be a strap, band, or cord formed of a woven or twisted material including, but not limited to: synthetic fibers or organic fibers such as cotton.

In an embodiment of the invention, the tension assembly 40 may include a ratcheting assembly 42 adapted to receive the tensioning member 20 and induce tension thereto between each of the first end 44 and the second end 46 by effectively reducing the length L of the tension member between each of the respective first and second ends 44, 46. The material forming the tensioning member 20 has an inherent elasticity, and creates tension by the resistance of the material to the elongation caused by the effective decrease in length L. Additionally, it is contemplated that other means of inducing tension in the tensioning member 20 may be provided, including, but not limited to: a binding device or twisting device.

In an embodiment of the invention, the means for fixing the location of the tensioning member 20 may comprise an adapter such as a strap-to-chain adapter 48 as disclosed in U.S. Pat. No. 5,762,455, issued in the name of long and incorporated herein by reference. The strap-to-chain adapter 48 is comprised of a tether aperture 50, an arcuate edge wall 52, a tensioning aperture 54, and an attachment aperture 56 where the tether aperture 50 is further defined by a tension bar 58 at each end of the tether aperture 50 and where the tether aperture 50 is defined as being substantially rectangularly elongated. The tensioning member 20 pulls against an edge that is integrally connected to the tensioning aperture 54 and further helps to define the tensioning aperture 54.

In another embodiment of the invention, the means for fixing the location of the tensioning member 20 may comprise a ring or loop (not shown) formed of a rigid material, placed onto each respective vertical member 12, 14 in the same manner as the strap-to-chain adapter 48 of the previous embodiment. The ring or loop may be formed of materials including, but not limited to: wire, wire rope, cord, webbing, metal, and plastic.

In another embodiment of the invention, it is contemplated that the associated first and second attachments 36, 38 of the tensioning member may be adapted to directly attach to each respective first and second vertical member 12, 14, and may be further adapted to receive a plurality of tethers 24.

In an embodiment of the invention, each of the plurality of tethers 24 may comprise a predefined length of cord having a first end 45 and a second end 47. The first end 45 of the cord may be affixed to the strap-to-chain adapter 48 by a suitable form of connection including, but not limited to: knots and crimped or spliced loops. The second end 47 of the cord may be affixed to one of the plurality of anchors 26. The cord may be formed from materials including, but not limited to: rope, twine, webbing, bands, wire, and wire rope.

In another embodiment of the invention, each of the plurality of tethers 24 is formed of a planar band (not shown), having an associated width W that is proportionally larger than an associated thickness T, and is formed of a solid material including, but not limited to metal. Additionally, it is contemplated that the plurality of tethers 24 may comprise link chains of varying sizes and formed of a variety of materials including, but not limited to metal.

Figure 5:
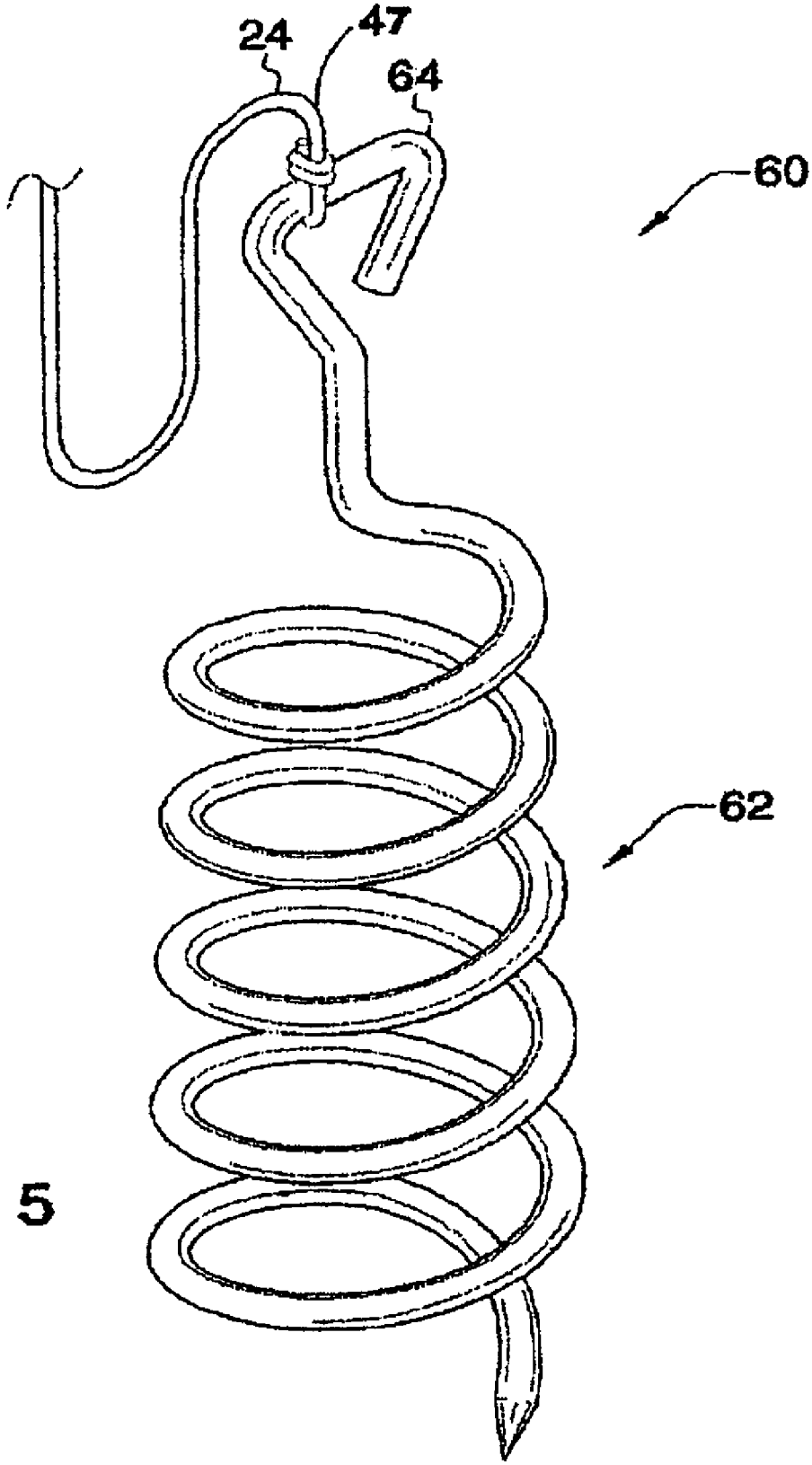
FIG. 5 illustrates a detail view of an anchor and cord used for lateral support of an unsupported span in accordance with an embodiment of the invention.

In an embodiment of the invention, the plurality of anchors 26 may be screw anchors 60, as illustrated in FIG. 5. The screw anchor 60 may be formed from a predefined length of a solid material. The solid material is formed in the shape of a helical thread 62, whereby the anchor may be fixed in a desired location by a user turning the screw anchor 60 such that the helical thread 62 engages the ground and draws the screw anchor 60 deeper into the ground with each successive turn until the screw anchor 60 reaches a depth desired by a user. An upper loop 64 is also formed on the screw anchor 60 such that a user may affix a tether 24 to the screw anchor 60.

In another embodiment of the invention, it is contemplated that the each of the plurality of anchors 26 may be a stake (not shown) having a first end; a second end; a length L; a loop or other means of retaining a cord formed at the first end for affixing a cord thereto; and a sharp point formed at the second end for being pushed or driven into the ground.

A method of use is also provided wherein a user assembles and erects an unsupported span 10 by completing the following steps. First, a user passes a first end 44 of a first vertical member 12 through an upper clamp 30. A user then passes a first end 44 of a second vertical member 14 through an upper clamp 30. A user then passes the first end 44 of the first vertical member 12 through a first hole 28 passing through a first end 44 of a upper horizontal member 16. The first end 44 of the second vertical member 14 is then passed through a second hole 28 passing through the second end 46 of the upper horizontal member 16. The first end 44 of the first vertical member 12 is then passed through a lower clamp 32 and the first end 44 of the second vertical member 14 is then passed through a lower clamp 32.

Each of the respective associated upper and lower clamps 30, 32 and the upper horizontal member 16 are placed in the position desired by the user. The user then tightens each of the respective upper and lower clamps 30, 32 thereby fixing the position of the upper horizontal member 16 with respect to the first and second vertical members 12, 14.

A user then passes the first end 44 of the first vertical member 12 through a first strap-to-chain adapter 48 and the first end of the second vertical member 14 through a second strap-to-chain adapter 48.

The first end 44 of the first vertical member 12 is then passed through an upper clamp 30 and first end 44 of the second vertical member 14 is passed through an upper clamp 30. The first end 44 of the first vertical member 12 is then passed through a first hole 28 passing through a first end 44 of a lower horizontal member 18 and the first end 44 of the second vertical member 14 is then passed through a second hole 28 passing through a second end 46 of the lower horizontal member 18. Each of the respective first ends 44 of the first and second vertical members 12, 14 is then passed through a respective lower clamp 32.

Each of the respective associated upper and lower clamps 30, 32 and the lower horizontal member 18 are placed in the position desired by the user. The user then tightens each of the respective upper and lower clamps 30, 32, thereby fixing the position of the lower horizontal member 18 with respect to the first and second vertical members 12, 14.

The tensioning member 20 is then affixed to each of the first and second strap-to-chain adapters 48 by the first and second attachments 36, 38 of the tensioning member. The user then manipulates a tensioning assembly 40, thereby creating tension in the tensioning member 20 and causing the unsupported span 10 to become rigid.

The assembled unsupported span 10 is then placed in a vertical orientation with respect to the ground with the each of the respective second ends 46 of the first and second vertical members 12, 14 being placed in mechanical contact with the ground. Optionally, the respective second ends 46 of the first and second vertical members 12, 14 may be driven into the ground.

A plurality of anchors 26 is then oriented at a plurality of locations desired by the user. Each of the plurality of tethers 24 is then affixed to the plurality of anchors 26, thereby providing lateral support to the unsupported span 10.

While several aspects have been presented in the foregoing detailed description, it should be understood that a vast number of variations exist and these aspects are merely an example, and it is not intended to limit the scope, applicability or configuration of the invention in any way. Rather, the foregoing detailed description provides those of ordinary skill in the art with a convenient guide for implementing a desired aspect of the invention and various changes can be made in the function and arrangements of the aspects of the technology without departing from the spirit and scope of the appended claims.

What is claimed is:

1. An unsupported span device for portable structures and portable signage comprising:

a first vertical member; and a second vertical member that cooperates with the first vertical member such that the first vertical member and the second vertical member provide vertical load-bearing capability to the unsupported span;

an upper horizontal member and a lower horizontal member for coupling the first vertical member with the lower horizontal member, and for providing a bearing surface for a load applied to the unsupported span;

means for fixing the location of the upper horizontal member and the lower horizontal member with respect to the first vertical member and the second vertical member including a set of clamps, including an upper clamp and a lower clamp associated with each end of each respective horizontal member, whereby each of the respective clamps is adapted to be removably mounted around an outer periphery of each respective vertical member using a compressive force applied by the clamp when the clamp is manipulated by a user;

a tensioning member for inducing tension between the first vertical member and the second vertical member;

means for fixing the location of the tensioning member with respect to the first vertical member and the second vertical member;

a plurality of tethers for laterally stabilizing the unsupported span; and a plurality of anchors for providing fixed points of attachment for the plurality of tethers.

2. The unsupported span of claim 1, wherein the upper horizontal member comprises:

an associated first end including an associated first opening defining a first end hole; and an associated second end including an associated second opening defining a second end hole.

3. The unsupported span of claim 1, wherein the lower horizontal member comprises:

an associated first end including an associated first opening defining a lower horizontal member first end hole; and an associated second end including an associated second opening defining a lower horizontal member second hole, wherein each associated lower horizontal member opening is adapted to receive a vertical member therethrough.

4. The unsupported span of claim 1, wherein each of the first vertical member, second vertical member, upper horizontal member, and the lower horizontal member has a tubular form.

5. The unsupported span of claim 1, wherein each of the first vertical member, second vertical member, upper horizontal member, and the lower horizontal member has a solid form having a geometric cross section.

6. The unsupported span of claim 1, wherein the tensioning member further comprises:

a flexible member having a first end including an associated first attachment;

a second end including an associated second attachment, wherein the first end and second end cooperate to define the length of the flexible member; and a tensioning assembly that may be manipulated by a user to induce stress in the tension member.

7. The unsupported span of claim 6, wherein the tensioning assembly comprises a ratcheting assembly.

8. The unsupported span of claim 1 wherein the means for fixing the location of the tensioning member comprises:

a strap-to-chain adapter including a tether aperture that operates to provide a point of attachment for a plurality of tethers;

an arcuate edge wall;

a tensioning aperture that cooperates with the arcuate edge wall to define a tensioning aperture; and a tensioning aperture that operates to provide both a point of attachment and means of locating the tensioning member.

9. The unsupported span of claim 1, wherein the plurality of tethers comprises:

a predefined length of cord having a first end affixed to a strap-to-chain adapter; and a second end affixed to one of the plurality of anchors.

10. The unsupported span of claim 1, wherein the plurality of anchors further comprises:

A plurality of screw anchors including a shank portion formed in the shape of a helical thread; and an upper loop formed on the anchor such that a user may affix a cord to the upper loop.

11. A method of forming an unsupported span comprising the steps of:

passing a first end of a first vertical member through an upper clamp;

passing a first end of a second vertical member through an upper clamp;

passing the first end of the first vertical member through a first hole passing through a first end of a upper horizontal member;

passing the first end of the second vertical member through a second hole passing through a second end of the upper horizontal member;

passing the first end of the first vertical member through a lower clamp;

passing the first end of the of the second vertical member through a lower clamp;

placing each of the respective associated upper and Lower clamps and the upper horizontal member in the position desired by the user;

tightening each of the respective upper and lower clamps is, thereby fixing the position of the upper horizontal member with respect to the first and second vertical members;

passing the first end of the first vertical member through a first strap-to-chain adapter;

passing the first end of the second vertical member through a second strap-to-chain adapter;

passing the first end of the first vertical member through an upper clamp;

passing the first end of the second vertical member is passed through an upper clamp;

passing the first end of the first vertical member through a first hole passing through a first end of a lower horizontal member;

passing the first end of the second vertical member through a second hole passing through a second end of the lower horizontal member;

passing each of the respective first ends of the first and second vertical members through a respective lower clamp;

placing each of the respective associated upper and lower clamps and the lower horizontal member in the position desired by the user;

tightening each of the respective upper and lower clamps, thereby fixing the position of the second horizontal member with respect to the first and second vertical members;

affixing a tensioning member to each of the first and second strap-to-chain adapters by the first and second attachments of the tensioning member;

manipulating a tensioning assembly, thereby creating tension in the tensioning member and causing the unsupported span to become rigid;

placing the unsupported span in a vertical orientation with respect to the ground with the each of the respective second ends of the first and second vertical members being placed in mechanical engagement with the ground;

orienting a plurality of anchors at a plurality of locations desired by the user; and affixing the plurality of tethers to the plurality of anchors.

12. The method of claim 11, further comprising the step of driving the second end of each respective first vertical member and second vertical member into secure engagement with the ground.

13. An unsupported span device for portable structures and portable signage comprising:

a first vertical member; and a second vertical member that cooperates with the first vertical member such that the first vertical member and the second vertical member provide vertical load-bearing capability to the unsupported span;

an upper horizontal member and a lower horizontal member for coupling the first vertical member with the lower horizontal member, and for providing a bearing surface for a load applied to the unsupported span;

means for fixing the location of the upper horizontal member and the lower horizontal member with respect to the first vertical member and the second vertical member;

a tensioning member for inducing tension between the first vertical member and the second vertical member, wherein the tensioning member includes a flexible member having a first end including an associated first attachment, a second end including an associated second attachment, wherein the first end and second end cooperate to define the length of the flexible member, and a tensioning assembly that may be manipulated by a user to induce stress in the tension member, means for fixing the location of the tensioning member with respect to the first vertical member and the second vertical member;

a plurality of tethers for laterally stabilizing the unsupported span; and a plurality of anchors for providing fixed points of attachment for the plurality of tethers.

14. The unsupported span of claim 13, wherein the upper horizontal member comprises:

an associated first end including an associated first opening defining a first end hole; and an associated second end including an associated second opening defining a second end hole.

15. The unsupported span of claim 13, wherein the lower horizontal member comprises:

an associated first end including an associated first opening defining a lower horizontal member first end hole; and an associated second end including an associated second opening defining a lower horizontal member second hole, wherein each associated lower horizontal member opening is adapted to receive a vertical member therethrough.

16. The unsupported span of claim 13, wherein each of the first vertical member, second vertical member, upper horizontal member, and the lower horizontal member has a tubular form.

17. The unsupported span of claim 13, wherein the tensioning assembly comprises a ratcheting assembly.

18. The unsupported span of claim 13 wherein the means for fixing the location of the tensioning member comprises:

a strap-to-chain adapter including a tether aperture that operates to provide a point of attachment for a plurality of tethers;

an arcuate edge wall;

a tensioning aperture that cooperates with the arcuate edge wall to define a tensioning aperture; and a tensioning aperture that operates to provide both a point of attachment and means of locating the tensioning member.

* * * * *